US011452413B2

(12) United States Patent
Scott et al.

(10) Patent No.: US 11,452,413 B2
(45) Date of Patent: Sep. 27, 2022

(54) ACCESSORY TOOL FOR A SURFACE CLEANING APPARATUS

(71) Applicant: TTI (Macao Commercial Offshore Limited), Avenida da Praia Grande (CN)

(72) Inventors: Chloe Scott, Sutton Coldfield (GB); Tony Elkington, Matlock (GB); Edward Barrett, Wallingford (GB)

( * ) Notice: Subject to any disclaimer, the term of this patent is extended or adjusted under 35 U.S.C. 154(b) by 80 days.

(21) Appl. No.: 16/488,330

(22) PCT Filed: Feb. 9, 2018

(86) PCT No.: PCT/GB2018/050368
§ 371 (c)(1),
(2) Date: Aug. 23, 2019

(87) PCT Pub. No.: WO2018/154276
PCT Pub. Date: Aug. 30, 2018

(65) Prior Publication Data

US 2020/0015643 A1 Jan. 16, 2020

(30) Foreign Application Priority Data

Feb. 23, 2017 (GB) ..... 1702959

(51) Int. Cl.
*A47L 9/02* (2006.01)

(52) U.S. Cl.
CPC ..... *A47L 9/02* (2013.01)

(58) Field of Classification Search
CPC ..... A47L 9/02; A47L 9/09; A47L 11/4044
(Continued)

(56) References Cited

U.S. PATENT DOCUMENTS 7,210,197 B2 * 5/2007 Fedorka ..... A47L 9/02
15/415.1
9,186,027 B2 * 11/2015 Genn ..... A47L 9/02
(Continued)

FOREIGN PATENT DOCUMENTS

DE 1860267 U 10/1962
GB 494826 A * 11/1938 ..... A47L 9/02
(Continued)

OTHER PUBLICATIONS

United Kingdom Patent Office Search Report for Application No. 1702959.6, dated Jun. 27, 2017, 1 page.
(Continued)

*Primary Examiner* — Monica S Carter
*Assistant Examiner* — Sarah Akyaa Fordjour
(74) *Attorney, Agent, or Firm* — Michael Best & Friedrich LLP

(57) ABSTRACT

An accessory tool for a surface cleaning apparatus, the apparatus including a source of suction, the tool including a body including a dirty air inlet in a tool surface which faces a surface to be cleaned in use; and a neck connected to the body, the neck including first and second passages fluidly connected to each other; wherein the first passage has a smaller cross sectional area than the second passage; wherein the dirty air inlet is fluidly connected to the first and second passages; wherein the first passage has a cross sectional area which is formed by first and second sides connected by third and fourth sides; and wherein the third and fourth sides generally extend towards each other as they extend from the second side to the first side.

20 Claims, 7 Drawing Sheets

(58) Field of Classification Search
USPC ..... 15/451.1
See application file for complete search history.

(56) References Cited

U.S. PATENT DOCUMENTS

| | | | | |
|---|---|---|---|---|
| 9,420,927 | B2 * | 8/2016 | Ventress | A47L 9/0666 |
| 2013/0047370 | A1 * | 2/2013 | Santiago | A47L 9/02 15/414 |
| 2017/0296009 | A1 * | 10/2017 | Carter | A47L 9/0411 |

FOREIGN PATENT DOCUMENTS

| | | | |
|---|---|---|---|
| GB | 494826 | A | 11/1938 |
| GB | 958445 | A | 5/1964 |
| JP | 2012228376 | A | 11/2012 |

OTHER PUBLICATIONS

International Search Report and Written Opinion for Application No. PCT/GB2018/050368, dated Apr. 24, 2018, 9 pages.

* cited by examiner

ACCESSORY TOOL FOR A SURFACE CLEANING APPARATUS

CROSS-REFERENCE TO RELATED APPLICATIONS

This application is a U.S. National Phase of International Patent Application No. PCT/GB2018/050368, filed Feb. 9, 2018, which claims priority to UK Patent Application No. 1702959.6, filed Feb. 23, 2017, the entire contents all of which are hereby incorporated by reference herein.

Field FIELD

This invention relates to an accessory tool for a surface cleaning apparatus which includes a source of suction.

BACKGROUND

The use of accessory tools for cleaning surfaces which floor tools cannot easily clean or are not suitable therefor are known. The accessory tools may be adapted to clean those areas that floor tools cannot easily reach. Typically, an accessory tool is provided with a body having a dirty air inlet and a neck connected to the body having an outlet for connection with the source of suction of a vacuum cleaner to permit the suctioning of dirt from the surface to be cleaned.

Accessory tools may include upholstery tools for cleaning upholstery and crevice tools.

SUMMARY

It is desired to optimise the flow of air through such tools to improve their efficiency, and therefore their ability to carry dirt-laden air away from the surface to be cleaned.

There is provided an accessory tool for a surface cleaning apparatus, the apparatus including a source of suction, the tool including:

a source of suction, the tool including:

a body including a dirty air inlet in a tool surface which faces a surface to be cleaned in use; and a neck connected to the body, the neck including first and second passages fluidly connected to each other;

wherein the first passage has a smaller cross sectional area than the second passage;

wherein the dirty air inlet is fluidly connected to the first and second passages;

wherein the first passage has a cross sectional area which is formed by first and second sides connected by third and fourth sides; and wherein the third and fourth sides generally extend towards each other as they extend from the second side to the first side.

The first and second sides may be curved.

The third and fourth sides may be generally linear.

The cross sectional area of the first passage may be generally circular with first and second circular segments removed, each circular segment having a chord corresponding to the third and fourth sides.

An angle formed by the third and fourth sides may be acute.

The cross sections of the first and second passages may be generally perpendicular to a generally elongate axis of the neck.

The second passage may have a cross sectional area which is generally circular.

The second passage may be positioned above the first passage and the first and second passage may share a common axis.

The first passage may be closer to the body than the second passage.

The second passage may taper towards the first passage as it extends thereto.

The neck may have an elongate axis which may form an angle of between 30 and 60 degrees to a central portion of the tool surface.

The third and fourth sides may extend towards each other towards a front of the tool.

The dirty air inlet may extend across the body.

The tool may further include a connecting portion having first and second sides which curve from the dirty air inlet to the second passage which fluidly connects the dirty air inlet to the second passage.

The dirty air inlet may be generally linear.

BRIEF DESCRIPTION OF THE DRAWINGS

Embodiments of the invention will now be described by way of example only with reference to the accompanying figures, in which.

DETAILED DESCRIPTION

Figure 1:
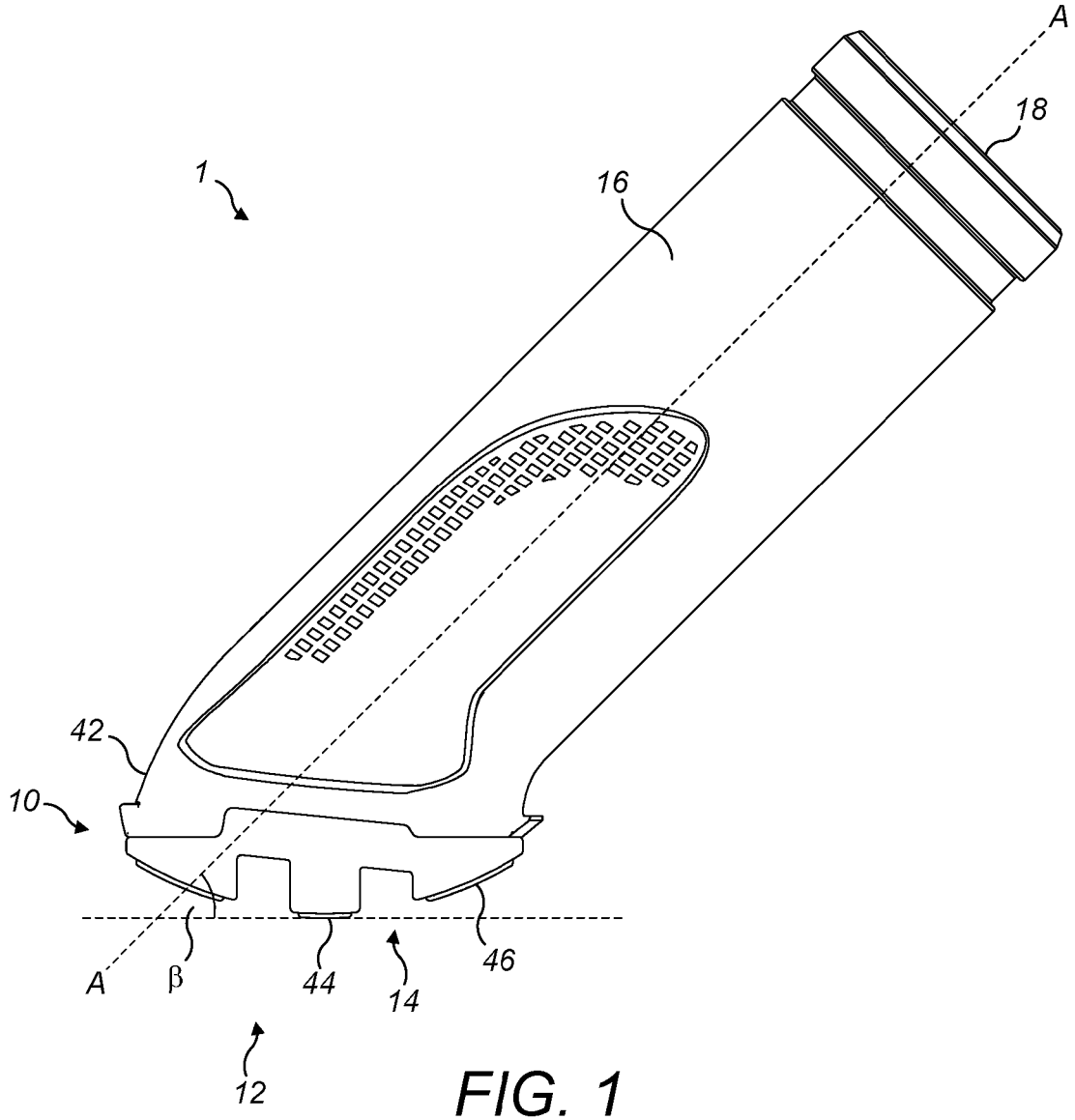
FIG. 1 is a side view of an accessory tool for a surface cleaning apparatus in accordance with an embodiment of the present invention.
Figure 2:
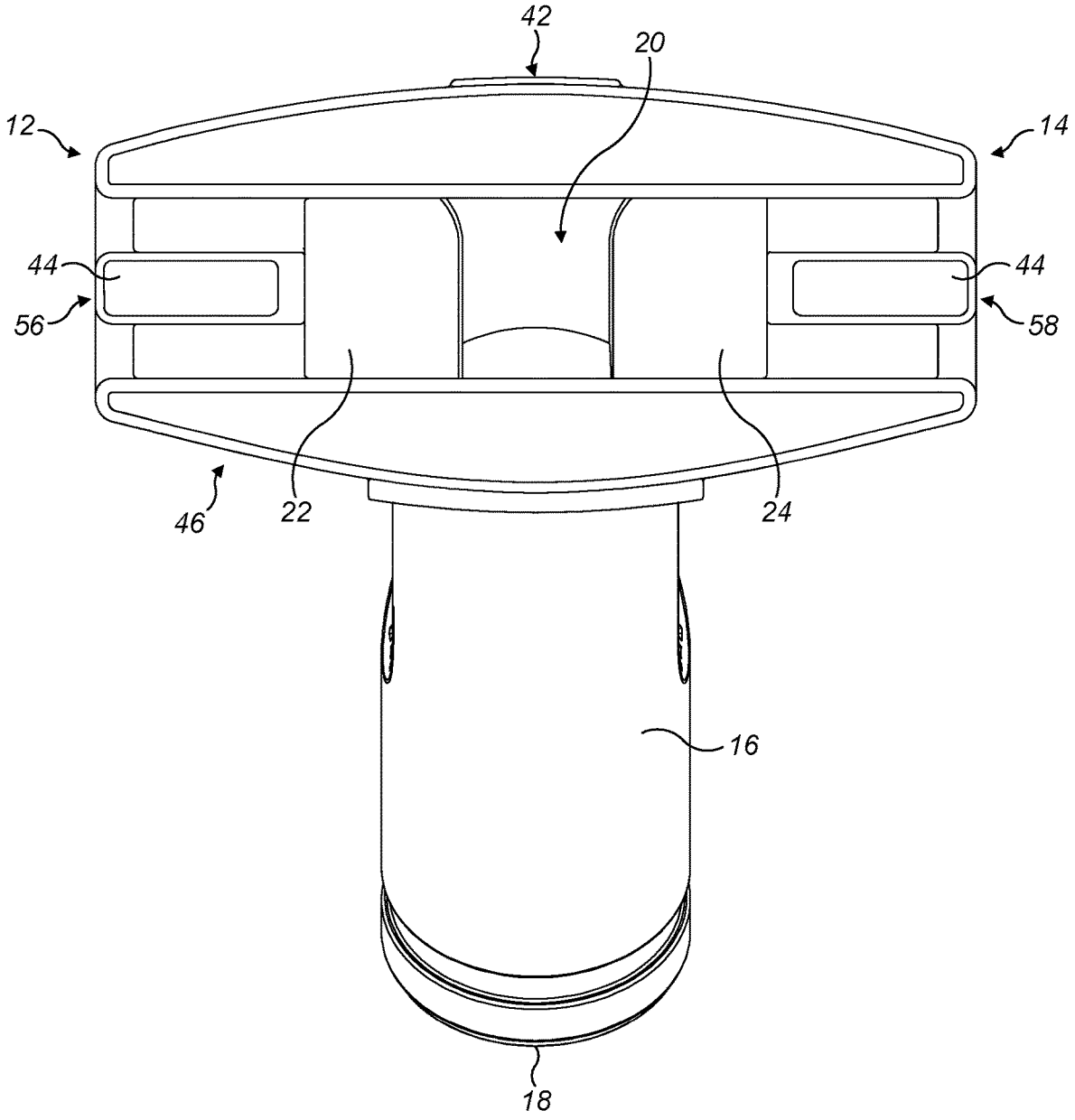
FIG. 2 is an underside view of the tool of FIG. 1.
Figure 3:
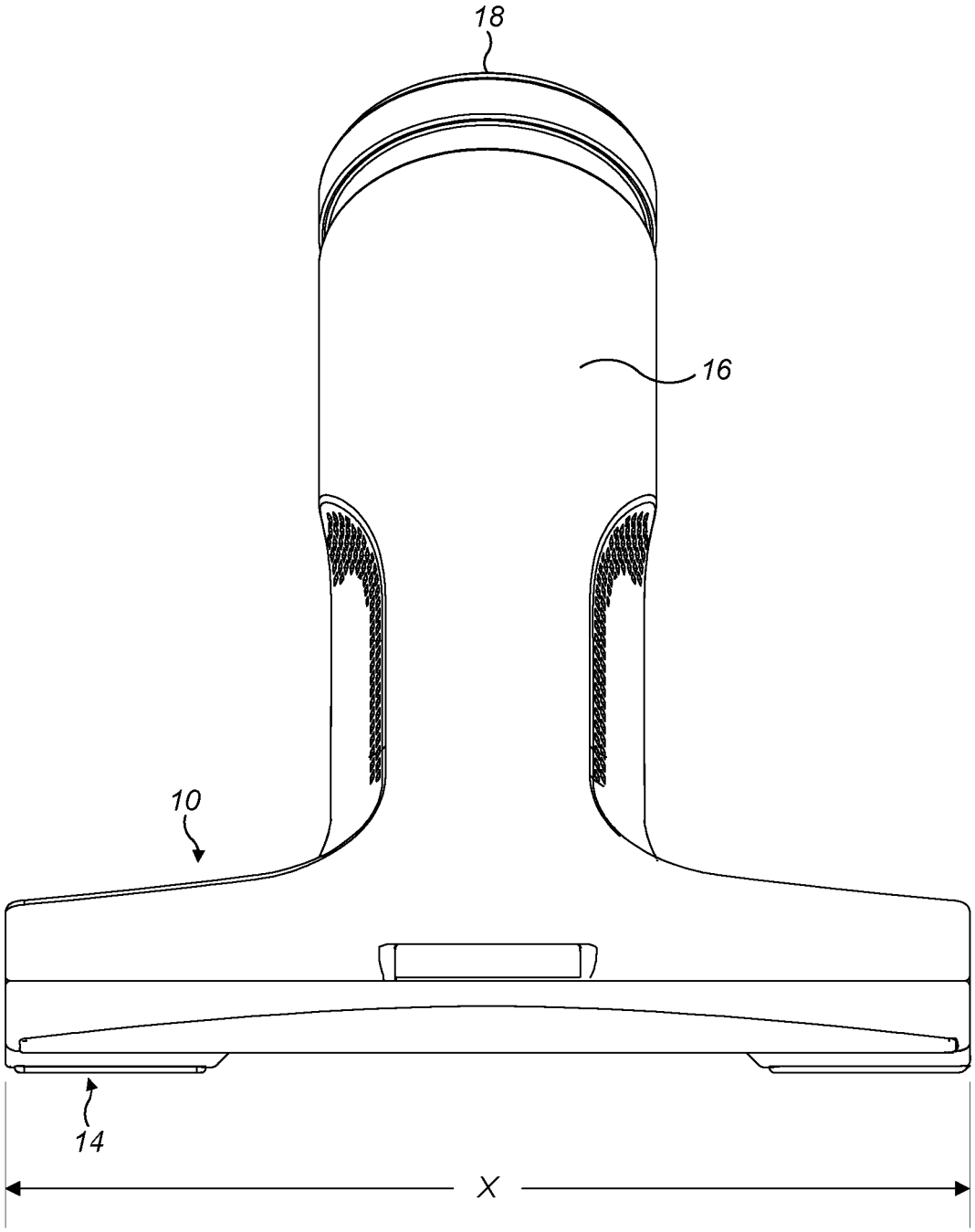
FIG. 3 is a front view of the accessory tool of FIG. 1.
Figure 4:
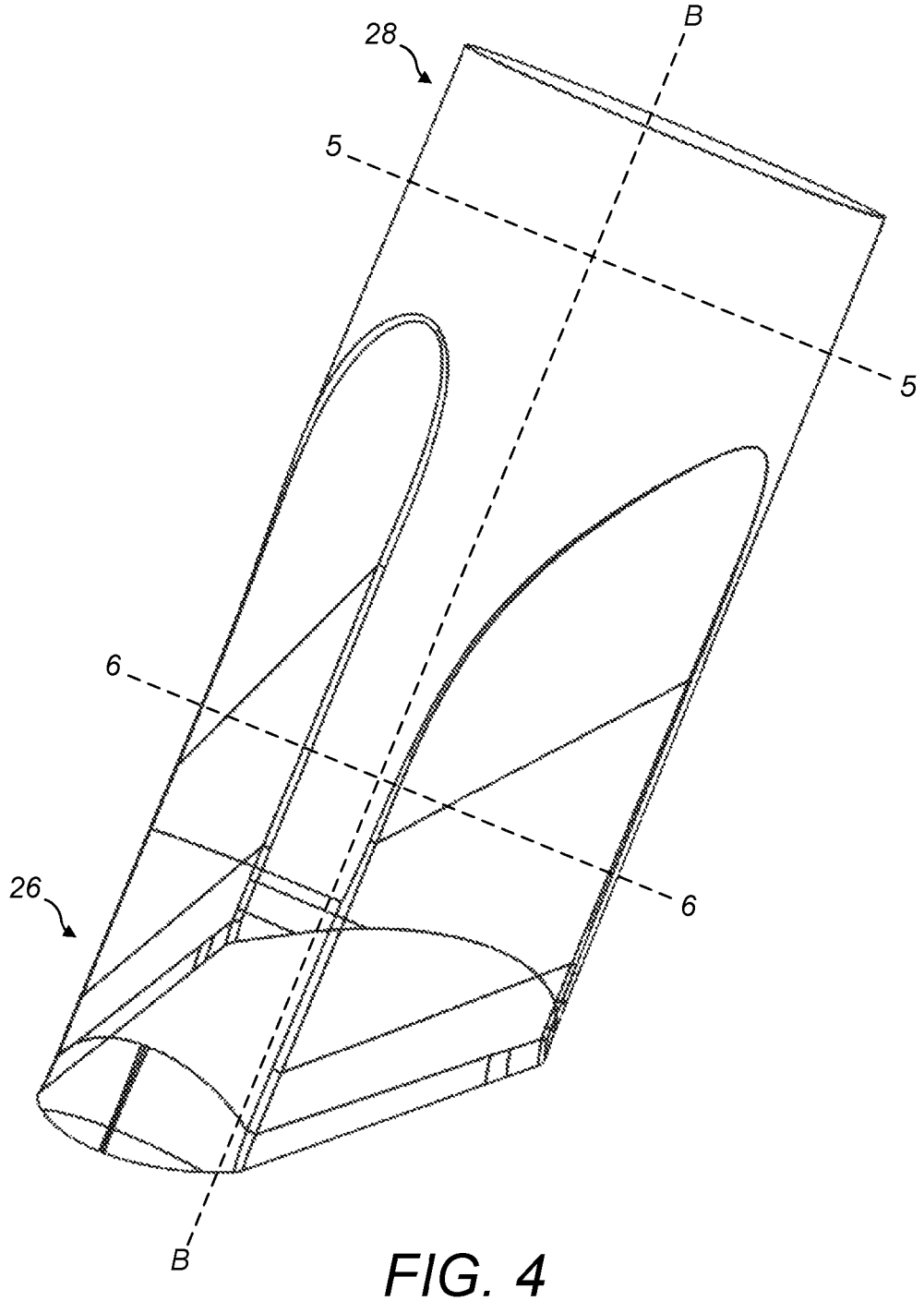
FIG. 4 is a perspective view of first and second passages in the neck of the tool of FIG. 1.

Referring to FIGS. 1 to 3 these show an accessory tool 1 in accordance with an embodiment of the present invention. The accessory tool 1 is for use with a surface cleaning apparatus where the surface cleaning apparatus includes a source of suction. In this particular embodiment the accessory tool 1 may be an upholstery tool.

The tool 1 includes a body 10 which includes a dirty air inlet 12. The dirty air inlet 12 is in a tool surface 14. In use, the tool surface 14 and dirty air inlet 12 face a surface to be cleaned.

The tool 1 also includes a neck 16 connected to the body. The neck includes a first passage 26 and a second passage 28. The first and second passages 26, 28 are fluidly connected to each other.

The first passage 26 has a smaller cross sectional area than the second passage 28. Providing a first passage 26 which has a smaller cross sectional area than the second passage 28 in combination with a particular shaped first passage 26 is advantageous, as discussed in more detail below.

The dirty air inlet 12 is fluidly connected to the first and second passages 26, 28. As will be apparent to the skilled person, because the first and second passages 26, 28 are fluidly connected to each other, only one of the first and second passages 26, 28 need be fluidly connected to the dirty air inlet 12 and then both of the first and second passages 26, 28 will be connected to the dirty air inlet 12.

The first passage 26 has a cross sectional area which is formed by a first side 30 and a second side 32. The first and second sides 30, 32 are connected by a third side 34 and a fourth side 36. The third and fourth sides 34, 36 generally extend towards each other as they extend from the second side to the first side.

It has been found that this tool 1 is a technical improvement over the prior art. In particular, dirt is entrained in the air flow in such a way as to provide a more efficient carriage of dirt away from the surface to be cleaned to the surface cleaning apparatus. Without wishing to be bound by theory, it is thought by the inventors that providing a constriction in the air flow passage between the dirty air inlet 12 and the outlet 18 is what provides this technical improvement. Again, without wishing to be bound by theory, it is believed by the inventors that the constriction in the neck increases the velocity of the air—in other words, the volumetric flux or rate of volume flow across a unit area is increased. Because of this, it is thought that although the air flow through the first passage 26 is effectively reduced by the smaller cross sectional area, the velocity of the air is increased and the dirt is carried effectively through the neck 16 of the tool 1. Thus, although the sheer volume of air passing through the dirty air inlet 12 is decreased (relative to a prior art tool without a first passage having its particular shape and smaller cross sectional area), counterintuitively the suction provided is more effective at removing dirt from a surface to be cleaned. The gain in the technical performance is much greater than might otherwise have been expected.

The body 10 may have a front, or front portion 42, which is positioned forwardly of the dirty air inlet 12. The body may have a rear, or rearward portion 46, which is positioned rearwardly of the dirty air inlet 12. Left and right edges 56, 58 may also be provided. The left and right edges 56, 58 may extend between the front and rear.

One or more generally central portions 44 may be provided between the front 42 and rear 46 of the tool. The portions 44 may also be positioned at or near the left or right edges 56, 58 of the tool 1. Such generally central portions 44 can help to reduce clamping. Clamping may be a particular problem where a tool is used on a surface which is pliable, as the surface may conform to the shape of the dirty air inlet 12 of the tool 1 and thereby block the dirty air inlet 12. By providing a or the portion 44 a pliable surface may be held away from the dirty air inlet and any clamping reduced or avoided.

The neck 16 may have a generally elongate axis A. The elongate axis may run generally through the centre of the neck. The axis A may form an angle β to a central portion 44 of the tool surface. The angle β may be between 30 to 60°. The angle β may be between 40 to 50°. The angle β may be 45°.

The angle β may be positioned towards the rear of the tool 1.

The neck 16 may function as a handle, in use.

The combination of the angle β being in the above described ranges and the neck 16 functioning as a handle means that the tool 1 may be easy to use. In particular, the tool surface 14 and the dirty air inlet 12 may be naturally presented at a convenient angle.

The dirty air inlet 12 may extend across the body 10 of the tool. In particular, the dirty air inlet 12 may extend between the left and right edges 56, 58. The dirty air inlet may be generally linear.

The body 10 of the tool may have a width X between the left and right edges 56, 58. The width X may also correspond to the width of the dirty air inlet 12. X may be between 80 mm and 120 mm. X may be between 90 mm and 110 mm. X may be 105 mm.

Referring to FIGS. 2 to 6, the second passage 28 may have a cross sectional area which is generally circular.

As discussed above, the first passage has a cross sectional area which is formed by first 30 and second 32 sides connected by third 34 and fourth 36 sides where the third 34 and fourth 36 sides generally extend towards each other as they extend from the second side 32 to the first side 30. The first 30 and second 32 sides may be curved. However, they may, alternatively, be linear. The third 34 and fourth 36 sides may be generally linear. However, they may, alternatively, be curved.

Figure 6:
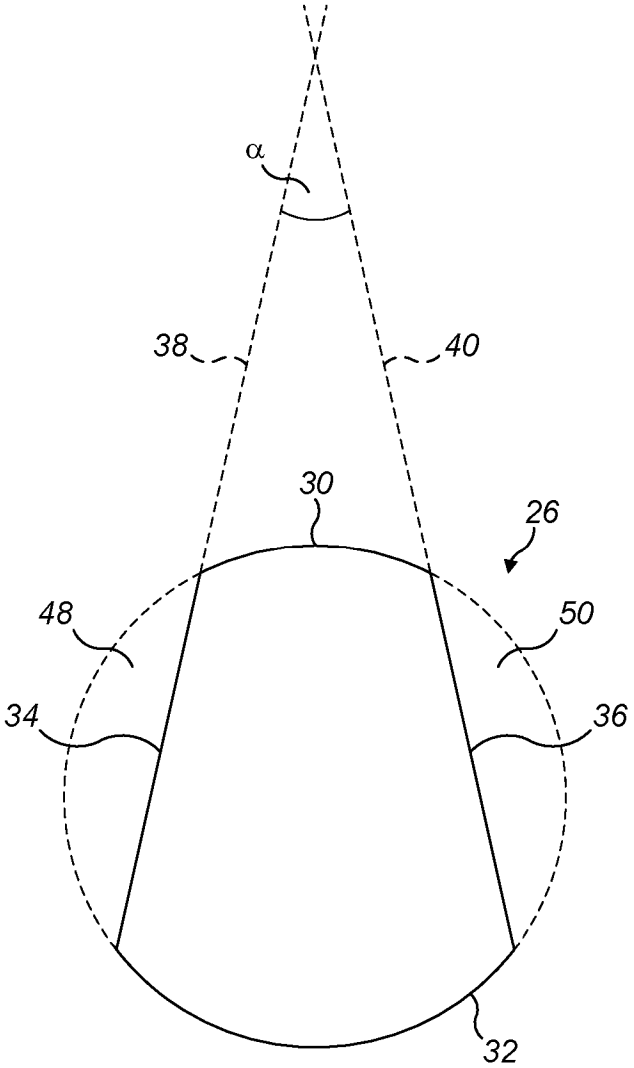
FIG. 6 shows a cross sectional view of the first passage of FIG. 5.
Figure 5:
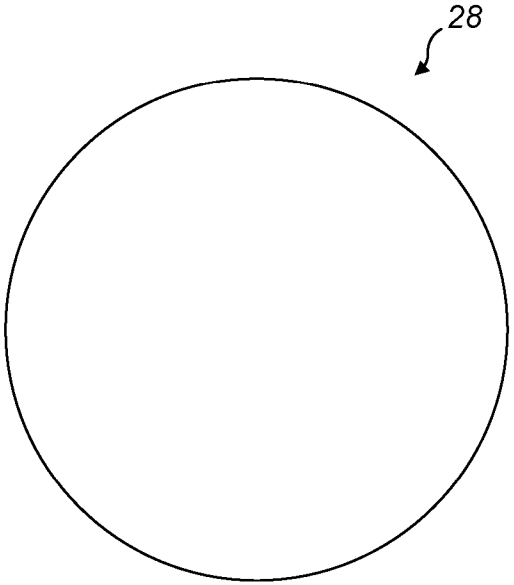
FIG. 5 shows a cross sectional view of the second passage of FIG. 4.
Figure 7:
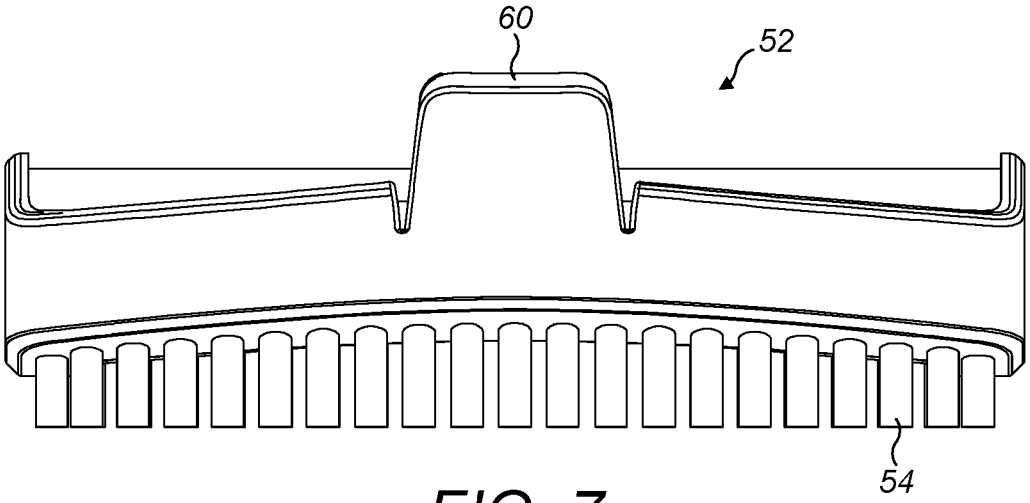
FIGS. 7 and 8 show a brush attachment for use with an accessory tool in accordance with an embodiment of the present invention.
Figure 8:
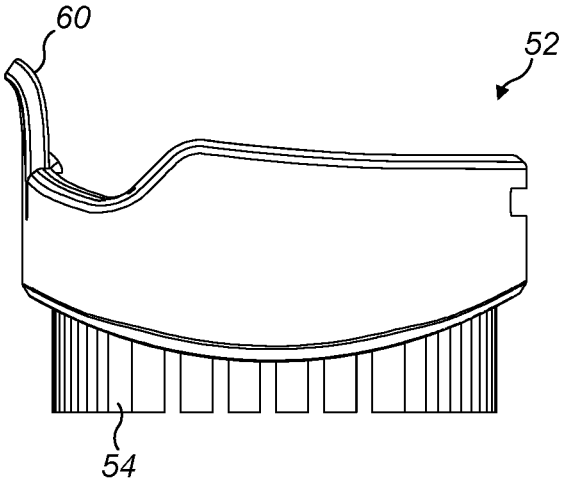
Figure 10:
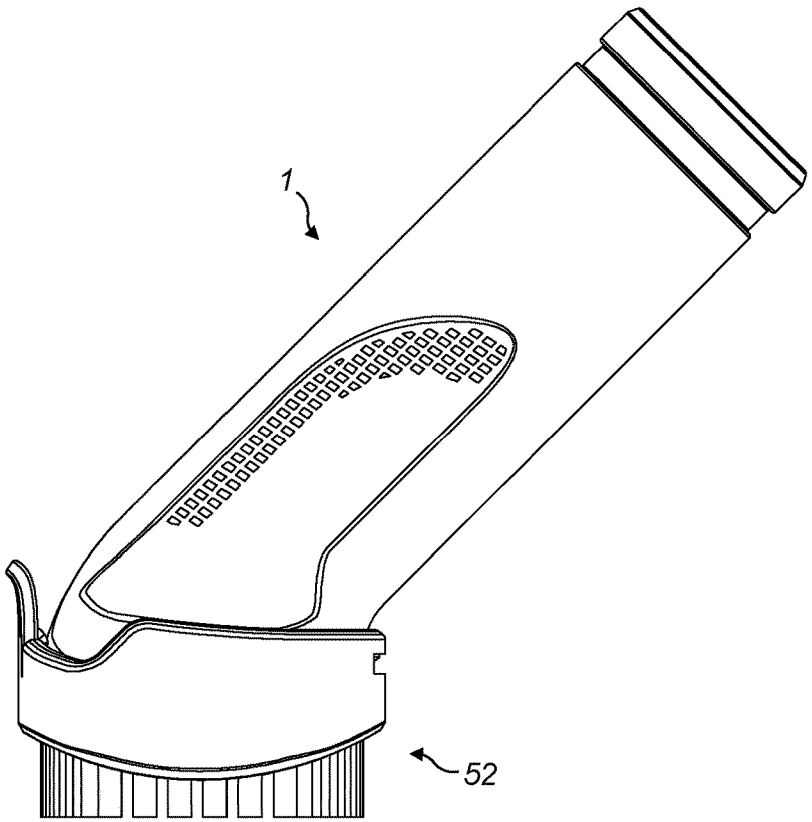
FIGS. 9 and 10 show the brush attachment of FIGS. 7 and 8 attached to the tool of FIG. 1.
Figure 9:
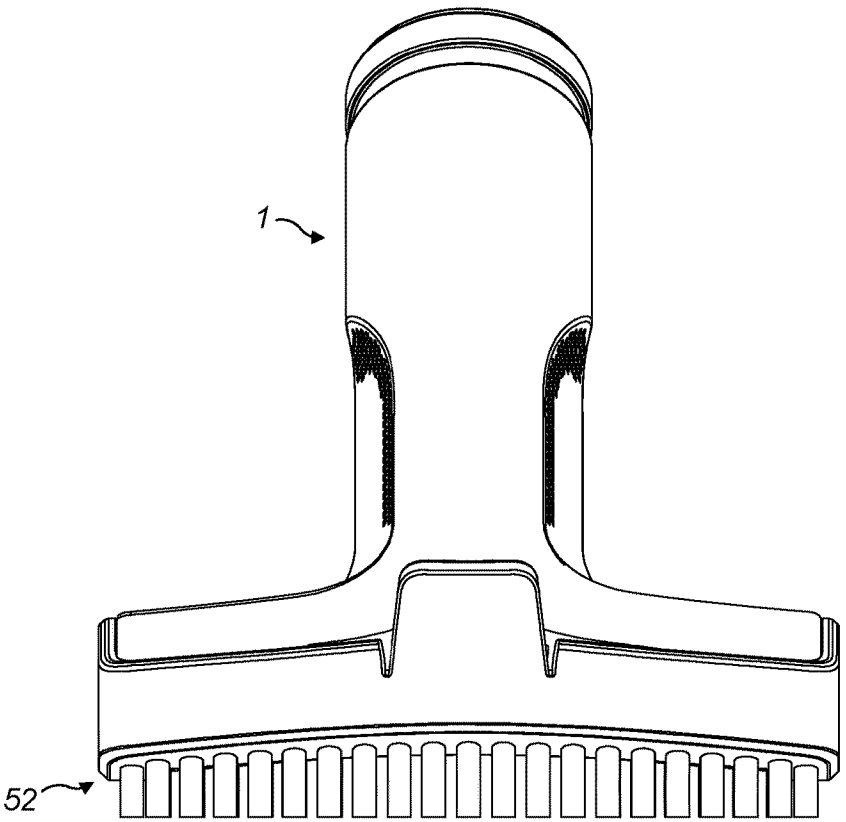

In particular with reference to FIG. 6, the cross sectional area of the first passage 26 may be generally circular with first and second circular segments 48, 50 removed. Each circular segment may be defined by a portion of a periphery of the circle and a chord which corresponds to the third or fourth sides 34, 36, respectively.

Above we explain that the first passage has a smaller cross sectional area than the second passage. By this we mean that the internal cross sectional area of the first passage is smaller than the internal cross sectional area of the second passage, thus providing a restricted flow path in the first passage 26 compared to the second passage 28. Similarly, where we discuss the shape of the first and second passages 26, 28 we are generally discussing the internal shape. The internal shapes of the first and second passages 26, 28 may correspond to the external shape of the first and second passages 26, 28 respectively.

An angle α formed by the third and fourth sides 34, 36, if they are imaginarily extended as shown by lines 38, 40 may be acute. This corresponds with the third and fourth sides extending towards each other.

The third and fourth sides 34, 36 may extend towards each other towards the front 42 of the tool 1. Such an arrangement has surprisingly been found to provide a particularly effective tool 1. Without wishing to be bound by theory, having faster moving air at the front of the tool provides an airflow pattern which is particularly effective at lifting dirt from a surface to be cleaned.

The second passage 28 may taper towards the first passage 26 as it extends thereto. In particular, this may be achieved by a transitional surface which connects the first and second passages 26, 28. Again, without wishing to be bound by theory, such tapering can provide an incremental transition between the first and second passages 26, 28 in use, thereby providing effective carrying of dirt through the neck 16 of the tool.

The dirty air inlet 12 is fluidly connected to the first and second passages 26, 28. This may be achieved by a connecting portion 20 provided between the dirty air inlet 12 and the neck 16. The connecting portion 20 may be provided with first and second sides 22, 24 which curve from the dirty air inlet 12 to the first passage 26 which fluidly connects the dirty air inlet 12 to the first passage 26.

Dirt entrained air can exit the tool 1 through an outlet 18 which is fluidly connected to the second passage 28.

The cross sections of the first and second passages 26, 28 may be generally perpendicular to the generally elongate axis A of the neck 16.

The first passage 26 may be closer to the body 10 and/or the inlet 12 than the second passage 28. In other words, the second passage 28 may be positioned above the first passage 26. By above, we mean that the second passage 28 may be positioned remote from the dirty air inlet 12, or body 10, relative to the first passage 26. Alternatively, the second passage 28 may be positioned closer to the body than the first passage 26. The first passage and the second passage 26, 28 may share a common axis B. The axis B may be parallel, or coaxial, with the axis A of the neck 16.

In use of such an example tool 1 dirt entrained air which comes into the tool 1 will first pass through the dirty air inlet 12 through the connecting portion 20 (when present) to the first passage 26 and then to the second passage 28.

There is also provided an optional brush attachment 52 as shown in FIGS. 7 to 10 having bristles 54 for use with the tool 1. The bristles 54 may be positioned around a periphery of the attachment 52. The brush attachment 52 may be connected to the tool 1 by a clip 60 provided on a forward portion of the attachment 52. The bristles 54 may provide a generally planar cleaning surface and enable the tool to be used for cleaning a variety of different surfaces.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An accessory tool for a surface cleaning apparatus, the apparatus including a source of suction, the tool including:

a body including a dirty air inlet in a tool surface which faces a surface to be cleaned in use; and a neck connected to the body, the neck including first and second passages fluidly connected to each other, the neck having an elongate axis;

wherein the first passage has a smaller cross sectional area than the second passage taken perpendicular to the elongate axis;

wherein the dirty air inlet is fluidly connected to the first and second passages;

wherein the first passage has a cross sectional area taken perpendicular to the elongate axis which is formed by first and second sides connected by third and fourth sides; and wherein the third and fourth sides generally extend towards each other as they extend from the second side to the first side in the cross sectional area of the first passage.

2. An accessory tool according to claim 1 wherein the first and second sides are curved.

3. An accessory tool according to claim 2 wherein the third and fourth sides are generally linear.

4. An accessory tool according to claim 3 wherein the cross sectional area of the first passage is generally circular with first and second circular segments removed, each circular segment having a chord corresponding to the third and fourth sides.

5. An accessory tool according to claim 4 wherein an angle formed by the third and fourth sides is acute.

6. An accessory tool according to claim 1 wherein the cross sections of the first and second passages are generally perpendicular to a generally elongate axis of the neck.

7. An accessory tool according to claim 1 wherein the second passage has a cross sectional area which is generally circular.

8. An accessory tool according to claim 1 wherein the second passage is positioned above the first passage and the first and second passage share a common axis.

9. An accessory tool according to claim 1 wherein the first passage is closer to the body than the second passage.

10. An accessory tool according to claim 1 wherein the second passage tapers towards the first passage as it extends thereto.

11. An accessory tool according to claim 1 wherein the neck has an elongate axis which forms an angle of between 30 and 60 degrees to a central portion of the tool surface.

12. An accessory tool according to claim 11 wherein the third and fourth sides extend towards each other towards a front of the tool.

13. An accessory tool according to claim 1 wherein the dirty air inlet extends across the body.

14. An accessory tool according to claim 1 further including a connecting portion having first and second sides which curve from the dirty air inlet to the second passage which fluidly connects the dirty air inlet to the second passage.

15. An accessory tool according to claim 1 wherein the dirty air inlet is generally linear.

16. An accessory tool according to claim 1 wherein the third and fourth sides are generally linear.

17. An accessory tool according to claim 1 wherein an angle formed by the third and fourth sides is acute.

18. An accessory tool according to claim 1 wherein the cross sections of the first and second passages are generally perpendicular to a generally elongate axis of the neck, wherein the second passage has a cross sectional area which is generally circular, and wherein the second passage is positioned above the first passage and the first and second passage share a common axis.

19. An accessory tool according to claim 1 wherein the first passage is closer to the body than the second passage, wherein the second passage tapers towards the first passage as it extends thereto, wherein the neck has an elongate axis which forms an angle of between 30 and 60 degrees to a central portion of the tool surface.

20. An accessory tool according to claim 1 further including a connecting portion having first and second sides which curve from the dirty air inlet to the second passage which fluidly connects the dirty air inlet to the second passage, wherein the dirty air inlet extends across the body, and wherein the dirty air inlet is generally linear.

* * * * *